US010589974B2

(12) United States Patent
Vesentini

(10) Patent No.: US 10,589,974 B2
(45) Date of Patent: Mar. 17, 2020

(54) APPARATUS FOR CAPPING AND PACKAGING UNIT COMPRISING SAID APPARATUS

(71) Applicant: REJVES S.R.L., Marmirolo (MN) (IT)

(72) Inventor: Renzo Vesentini, Marmirolo (IT)

(73) Assignee: REJVES S.R.L., Marmirolo (IT)

( * ) Notice: Subject to any disclaimer, the term of this patent is extended or adjusted under 35 U.S.C. 154(b) by 423 days.

(21) Appl. No.: 15/309,350

(22) PCT Filed: May 6, 2015

(86) PCT No.: PCT/EP2015/059972
§ 371 (c)(1),
(2) Date: Nov. 7, 2016

(87) PCT Pub. No.: WO2015/169863
PCT Pub. Date: Nov. 12, 2015

(65) Prior Publication Data

US 2017/0073205 A1 Mar. 16, 2017

(30) Foreign Application Priority Data

May 7, 2014 (IT) ..... PR20140008 U

(51) Int. Cl.
*B67B 3/20* (2006.01)

(52) U.S. Cl.
CPC ..... *B67B 3/2053* (2013.01); *B67B 3/20* (2013.01); *B67B 3/2066* (2013.01)

(58) Field of Classification Search
CPC ..... B67B 3/20; B67B 3/204; B67B 3/2053; B67B 3/2066; B67B 2201/10
(Continued)

(56) References Cited

U.S. PATENT DOCUMENTS 4,295,320 A * 10/1981 Willingham ..... B67B 3/18 53/201
5,339,597 A * 8/1994 Naka ..... B65B 59/02 141/144

(Continued)

FOREIGN PATENT DOCUMENTS

DE 20 2005 006430 U1 8/2006
EP 0 572 107 A1 12/1993

(Continued)

OTHER PUBLICATIONS

International Search Report, dated Jul. 30, 2015, from corresponding PCT application.

*Primary Examiner* — Hemant Desai
*Assistant Examiner* — Veronica Martin
(74) *Attorney, Agent, or Firm* — Young & Thompson

(57) ABSTRACT

A capping unit (100) for articles such as containers and/or bottles in general, of the type including at least one capping group (3) bearing one or more capping heads (8) for screwing caps (6) or capsules on the articles moved by at least one transport line (4). It includes at least one capping heads store (19), adapted to retain a series of capping heads (8), in order to allow the rapid and automatic exchange and substitution of the spindles (25) of the capping group (3); the capping group (3) being moved by an associated motorization, up to reaching the store (19) such to store and pick up, automatically from the group (3) itself the suitable capping head (8) as a function of the size of the caps (6) or capsules to be screwed.

10 Claims, 9 Drawing Sheets

(58) Field of Classification Search
USPC ..... 53/281, 282, 317, 331.5, 75
See application file for complete search history.

(56) References Cited

U.S. PATENT DOCUMENTS

| | | | | | |
|---|---|---|---|---|---|
| 5,467,527 | A * | 11/1995 | Zanini | B67B 3/2033 | 29/240 |
| 2010/0018158 | A1* | 1/2010 | Vesentini | B65B 7/2835 | 53/317 |
| 2010/0089004 | A1* | 4/2010 | Data | B67B 3/2033 | 53/317 |
| 2013/0309343 | A1* | 11/2013 | Stoiber | B65C 9/40 | 425/169 |
| 2017/0113909 | A1* | 4/2017 | Frey | B23Q 3/15786 | |

FOREIGN PATENT DOCUMENTS

| | | | | |
|---|---|---|---|---|
| EP | 2 295 226 | A1 | 3/2011 | |
| WO | WO-2009016502 | A1 * | 2/2009 | B67B 3/2033 |
| WO | 2014/174419 | A1 | 10/2014 | |

* cited by examiner

A

B

APPARATUS FOR CAPPING AND PACKAGING UNIT COMPRISING SAID APPARATUS

APPLICATION FIELD OF THE INVENTION

The present finding refers to the bottling field, in particular to apparatuses/plants for capping containers and/or filling them. More precisely, the finding refers to a linear machine.

With the expression linear machine it is intended a machine executing the filling and/or capping steps in line, during the advancing of objects/containers rows on at least one transport line.

STATE OF THE ART

Filling and capping machines are known that utilize rotating turntables, on whose periphery a plurality of heads, nozzles and capping heads are arranged for their operation.

Usually these are rotary machines.

Rotary machines are high cadence machines; they are more delicate machines which have anyway to assure a high operational yield. Moreover, they are expensive and require longer times for adaptation to different caps and/or containers.

DESCRIPTION AND ADVANTAGES OF THE FINDING

The object of the finding is to provide to the art a linear capping (and if needed with filling) apparatus in which a group called capping head store, is provided and adjacent to the capping line, and it can be used to execute an automatic format change of the capping heads adapted to screw capping.

Specifically, said capping group bears one or more capping heads for the screwing of caps or capsules on the filled article or container. Said groups operating on at least one motorized transport line for advancing one or more rows of objects to be capped.

The apparatus comprises at least one screw capping group (with a possible filling group associated to the capping apparatus) operating through a three-axis motor system with linear motors and/or brushless motors for the rotation of recirculating ball screws or toothed belts.

When the filling group is present, both groups, the capping and the filling ones, move synchronously: they are synchronized by a couple of robots or by a shared three-axis motor system with linear motors and/or brushless motors for the rotation of recirculating ball screws or toothed belts, in order to position said groups according to a parallel, vertical and approaching direction with respect to the line for transporting objects.

There is at least one rotating device for advancing the articles, bearing a plurality of pitch setting screw augers that can be selected based on the format to be filled and capped.

The linear capping apparatus comprises at least one capping heads pickup and release group, i.e. a capping heads store, which allows a quick capping means format change.

The capping unit 100 is meant as self sustaining modular unit; alternatively, the combination with the synchronized filling unit is provided, this comprising, aside of the transport line (and/or aside of the one or more benches/lines for picking-up the caps).

Said capping unit comprises at least one capping heads store, adapted to retain a series of capping heads in order to allow the rapid and automatic exchange and substitution of the spindles (i.e. heads) of the capping group.

The capping heads store is an accessory structure for parking spare heads, or in other words a space in which the heads can be stored and/or selected automatically by the apparatus itself, according to the type of objects to cap.

Said capping heads store group comprises a plurality of plates integral to a catenary wound on a closed ring path; the catenary moves said plates according to a horizontal sliding plane; support means for the respective capping heads are integral on top of plates; said means are positioned such that they can hold said heads with holding means pointing downwards, i.e. towards the plates, and pull studs, which will be linked to the capping group, pointing upwards.

Said objects and advantages are all achieved by the linear capping apparatus, object of the current finding, which is characterized as provided for in the appended claims.

BRIEF DESCRIPTION OF THE DRAWINGS

This and other characteristics will become more apparent from the following description of some illustrated embodiments, purely by way of non-limiting example, in the attached figures.

DESCRIPTION OF THE INVENTION

Figure 1:
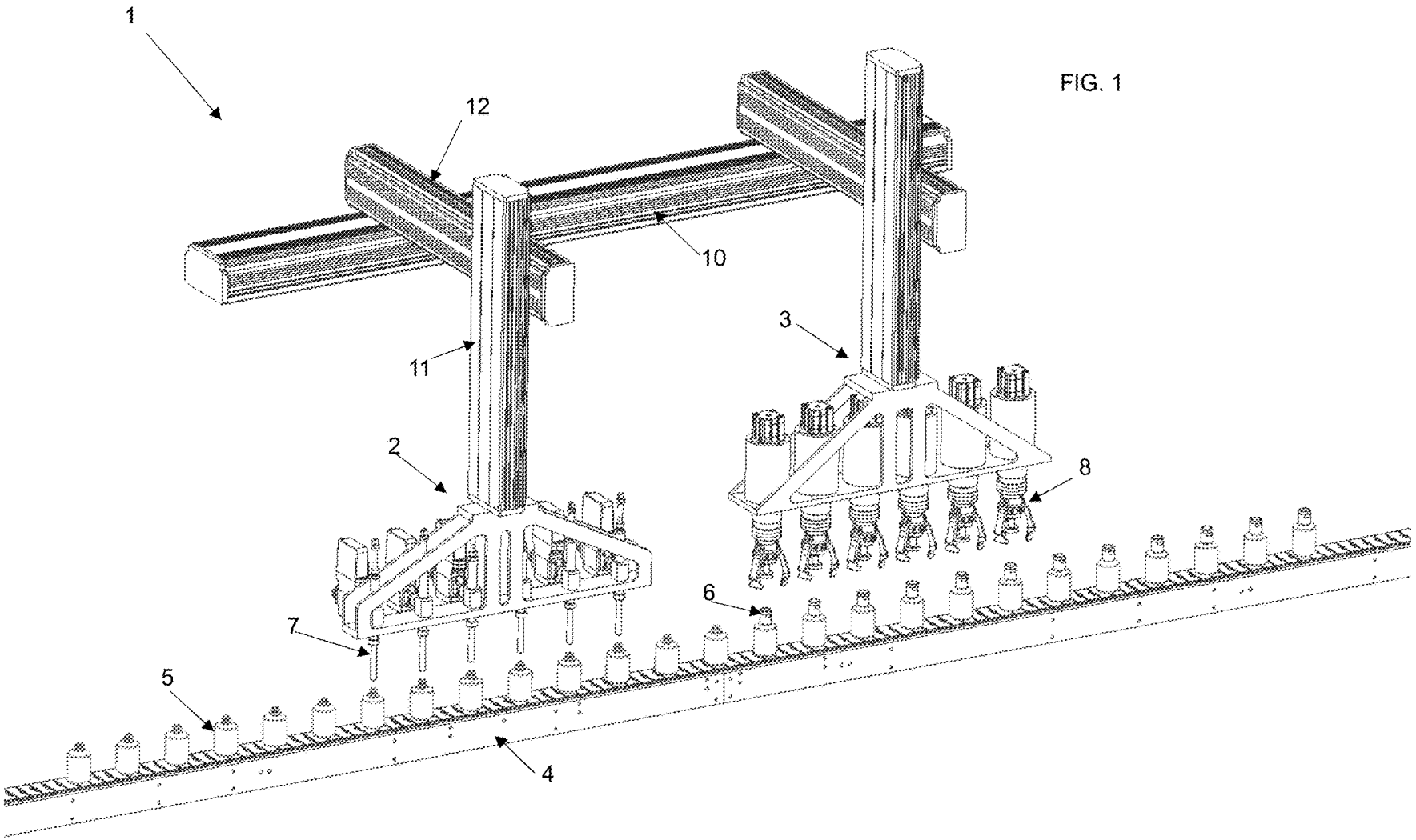
FIG. 1: Shows an example of a capping apparatus, with an associated filling group, comprising synchronized capping and filling groups operating on at least one motorized transport line for advancing one row of objects to be capped; the system provides for executing the screwing during at least one linear movement of the containers, i.e. in pursuit, using threaded caps or capsules. A three-axis motor system with linear motors and/or brushless motors for the rotation of recirculating ball screws or toothed belts controls the position of said capping groups, synchronizing them if needed with the possible filling group according to a parallel direction with respect to the line for transporting objects, according to a vertical direction and a perpendicular direction with respect to said line.

Referring to the figure, a filling and capping apparatus, is indicated in its entirety with 1. In the figure is shown by way of example the possibility of joining a filling group 2 and a capping group 3.

Apparatus 1 is used at end of the line, i.e. for the filling (group 2) and capping (group 3) steps.

Said steps are of the linear advancement type, that is, in contrast to what currently happens in big productions, rotary machines are not employed, instead taking advantage of the same containers 5 accumulation line 4 of the upstream plant, on which the aforesaid steps are executed.

Each of said groups 2, 3 bears respectively one or more filling heads 7 and one or more capping heads 8; the capping heads operate by screwing on the container such that the corresponding cap 6 (or capsule) is screwed on the container 5 once the object has been filled.

Groups 2 and 3 operate on a row of objects 5 moving on at least one same motorized transport line 4.

If needed, the objects are restrained to the right pace by known systems like screw augers and other equivalent systems. in this way the precise positioning of the row is guaranteed, whenever it is necessary to distance the products because of the multi-head top groups encumbrance.

In the example, the aforesaid groups 2,3 comprise a three-axis motor system with linear motors 10, 11 and 12, adapted to control, synchronously, the position of said groups according to a parallel, vertical and perpendicular direction with respect to the line for transporting objects.

The aforesaid three-axis motor system with linear motors comprises a combination of:

a. A single linear motor 10 for moving both groups according to a direction parallel to the line of advancement of the objects to be treated;

b. A linear motor 12 for each working group, the filling and the capping ones, for the movement perpendicular to the line of advancement of the objects to be treated;

c. A linear motor 11 for each working group, the filling and the capping ones, for the vertical movement, rising and/or lowering, with respect to the line of advancement of the objects to be treated such that the filling and capping can be executed.

According to a variant embodiment, said motorization system comprises even only one type of motors described in the aforementioned points a. b. c.

Alternatively, according to yet another variant embodiment, the aforesaid motorization system, instead of linear motors, comprises linear motors and/or brushless motors for the rotation of recirculating ball screws or toothed belts, but still adapted to move synchronously the two filling and capping groups. As an alternative, a couple of anthropomorphic or multi-axis robots can be employed.

Such a motorization system allows for the heads pursuit during the screwing on the advancing container.

In the case of combined groups, the motorization system will be able to control synchronously the capping and filling groups.

The apparatus, with the three-axis motor system, arranges both groups 2, 3 such that while the first is filling the containers/objects advancing on the line, the second executes the capping on adjacent containers/objects, keeping advancing on the line, previously filled by the filling group.

Figure 2:
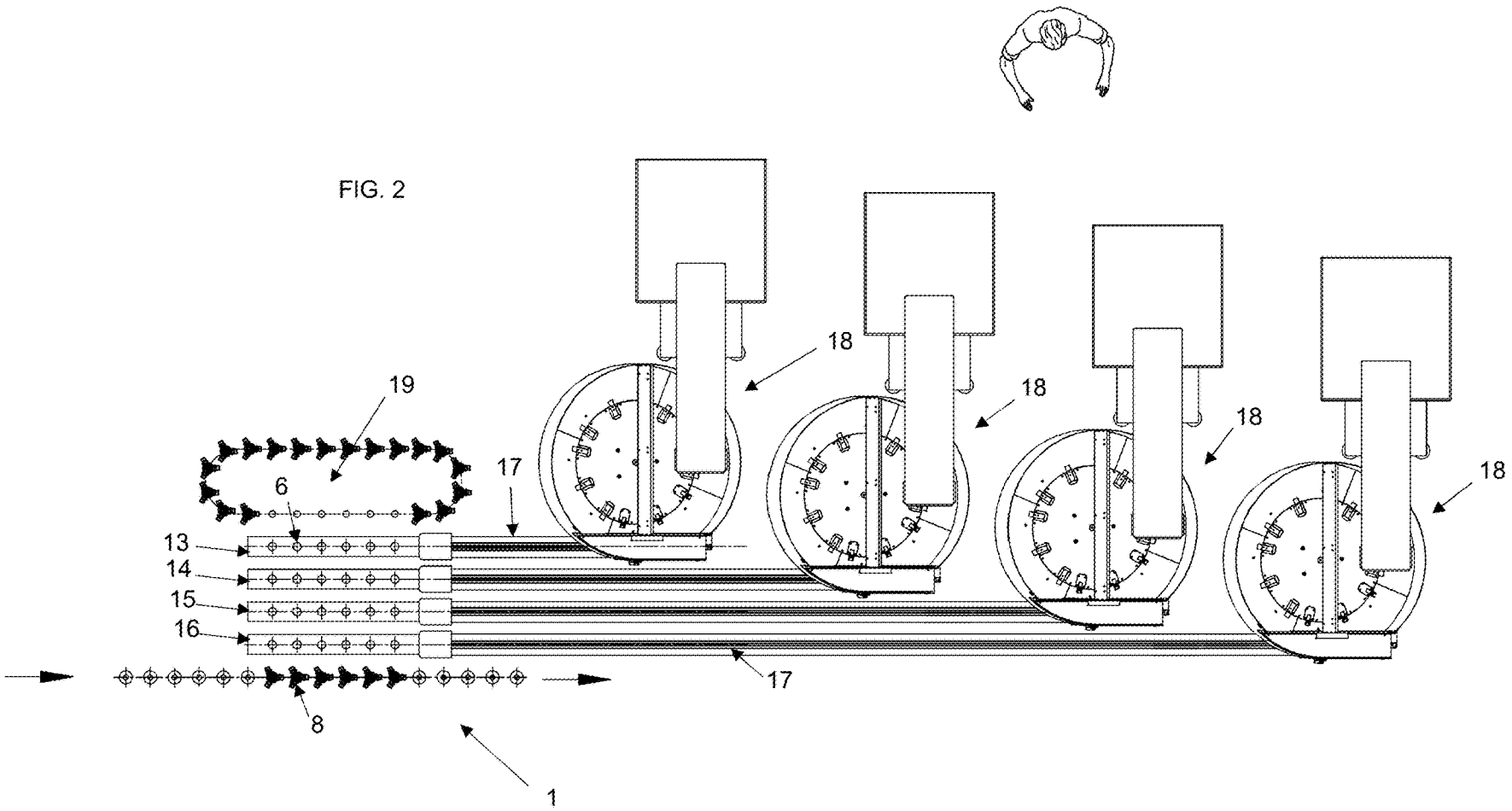
FIG. 2: Shows a top view, wherein the apparatus comprises one or more accumulation lines or benches, for feeding and advancing caps and/or capsules with which the capping can be provided for by means of the capping group, in turn equipped with plurality of capping heads; in this respect, it should be additionally observed the presence of a tool store for the automatic change of the capping heads, which is executed by the same control means of the moving group.
Figure 3:
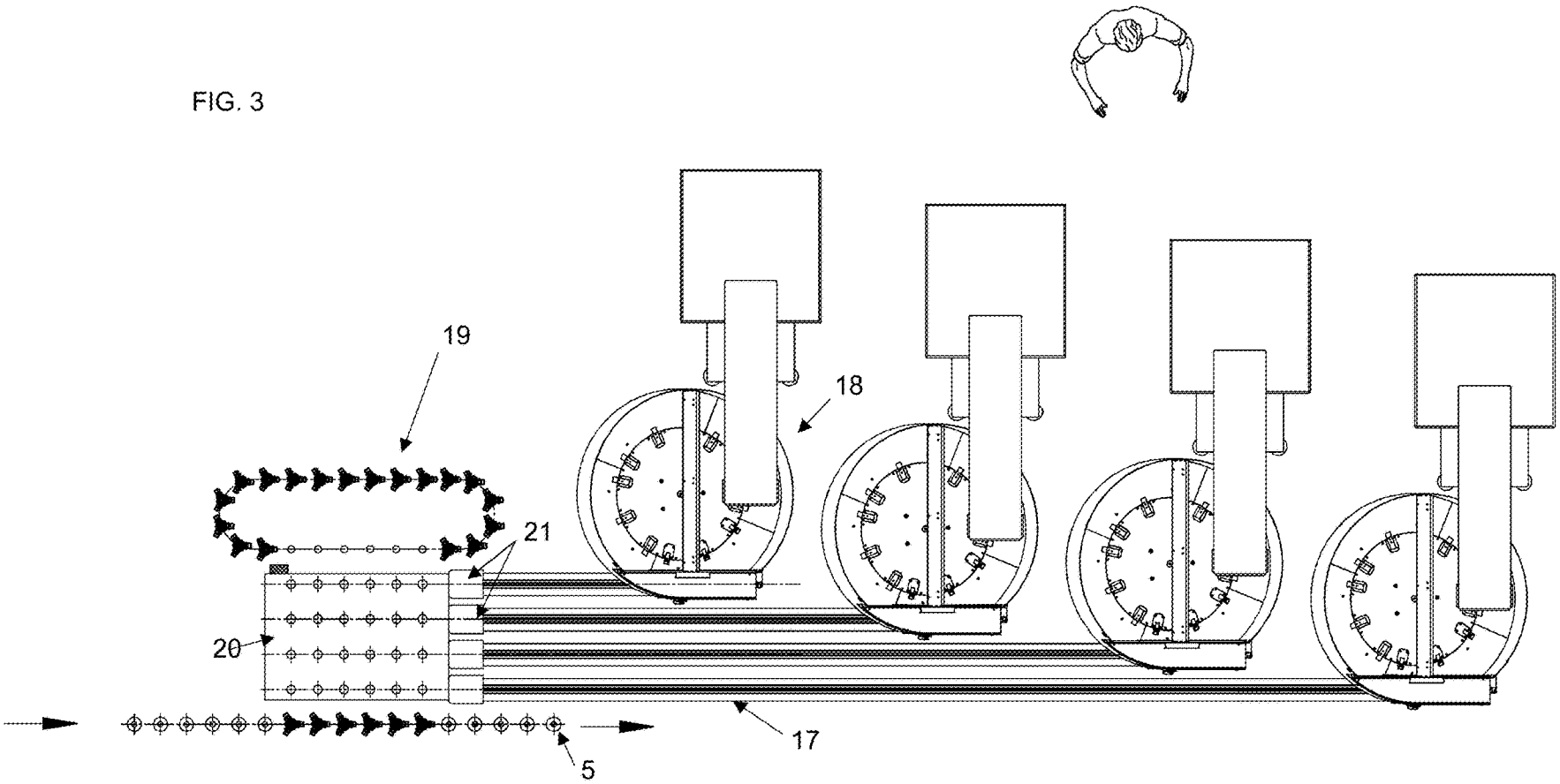
FIG. 3: Shows a top view of another variant embodiment of the finding; compared to the system in FIG. 2, the apparatus comprises a unique terminal accumulation line, which can advance the required caps and/or capsules line, blocking the others through stopping means placed upstream of the same line. in any case upstream there are corresponding advancing lines connected to the corresponding distribution apparatus.
Figure 6:
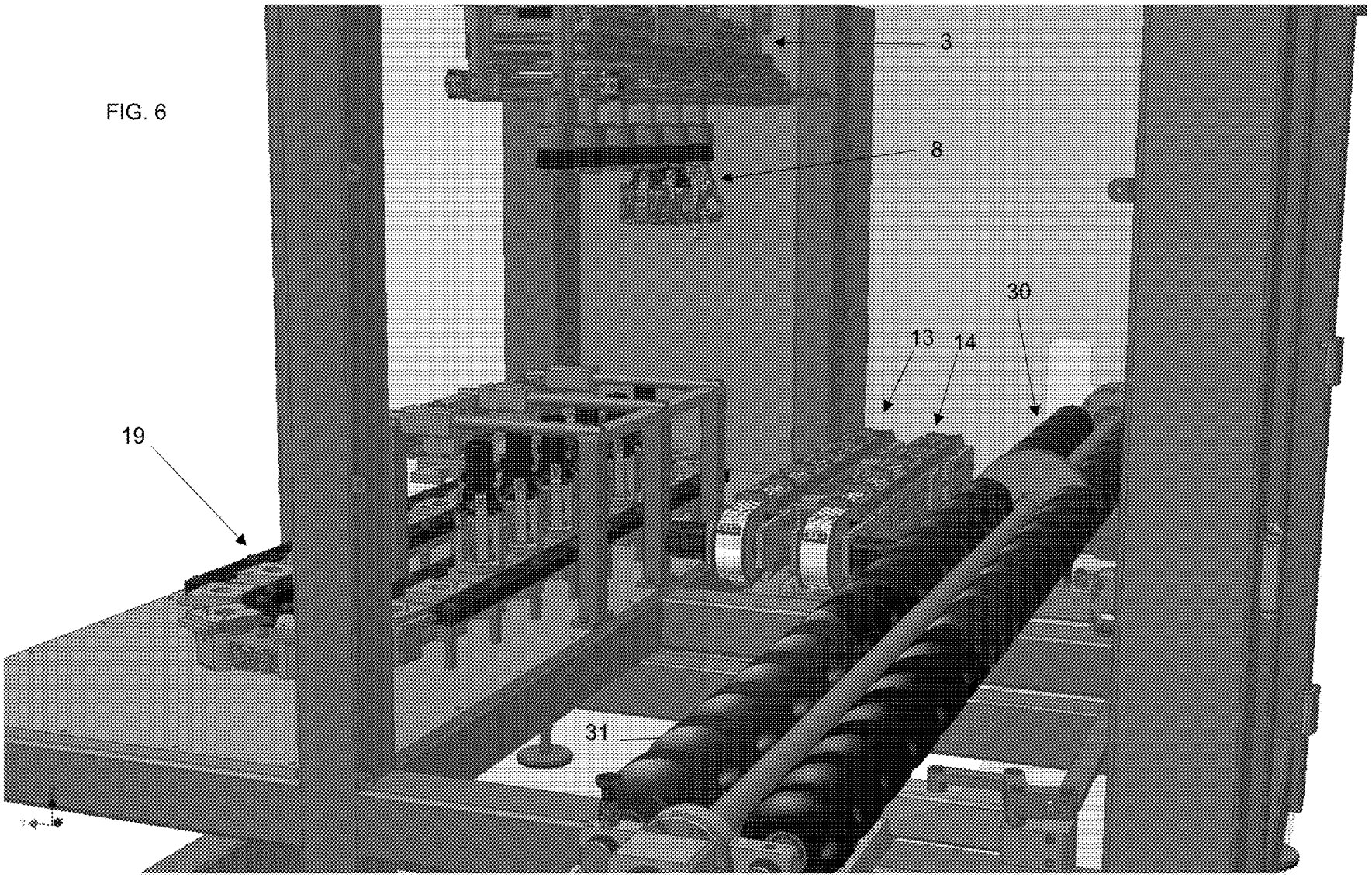

As aforementioned, the unit associated with one or more means or lines for supplying the caps 6 is also part of the finding. specifically, and especially referring to FIGS. 2,3 and 6, it should be observed that the apparatus or at least the capping unit comprises one or more lines 13, 14, 15, 16 or accumulating/feeding benches for the advancement and the arrangement of caps/capsules 6; this assists the capping group.

Said one or more accumulation lines 13, 14, 15, 16 are positioned adjacent to the filling apparatus and/or transport line.

The capping group 3 is adapted to implement the movement perpendicular to the transport line 4: in this way group 3 picks up the caps 6 (or the capsules to be screwed on the objects) from said series of means 13, 14, 15, 16 and positions them in the corresponding container previously filled and moving on the advancing line 4.

The example refers to caps accumulation lines or benches comprising independent terminal channels 13, 14, 15, 16, four of them in the example, each one being adapted to move caps and/or capsules picking-up them upstream from a corresponding distributing means 18.

Nevertheless, the solution in FIG. 3 shows a variation comprising also a unique terminal accumulation line 20, which can advance the needed caps and/or capsules row, blocking the remaining rows using stopping means 21 positioned upstream of the line itself. in any case there will be upstream corresponding advancing lines 17 linked to the respective distributing apparatus 18.

This allows for saving the number of used motorizations at the caps picking-up point 6.

The capping unit 100 is meant as self sustaining modular unit; alternatively, the combination with the synchronized filling unit is provided, this comprising, aside of the transport line 4 (and/or aside of the one or more benches/lines 13, 14, 15, 16, 20 for picking-up the caps 6), at least one capping heads store 19, adapted to retain a series of capping heads, designated with reference 8, in order to allow the rapid and automatic exchange and substitution of the spindles (i.e. heads 25) of the capping group 3.

The capping group 3 is moved by the associated motorization, up to reaching said store 19 such to store and pick up, automatically from the group 3 itself, the suitable capping head(s) 8 as a function of the size of the caps 6 or capsules to be screwed and waiting on the cap 6 picking-up line 4.

Figure 7:
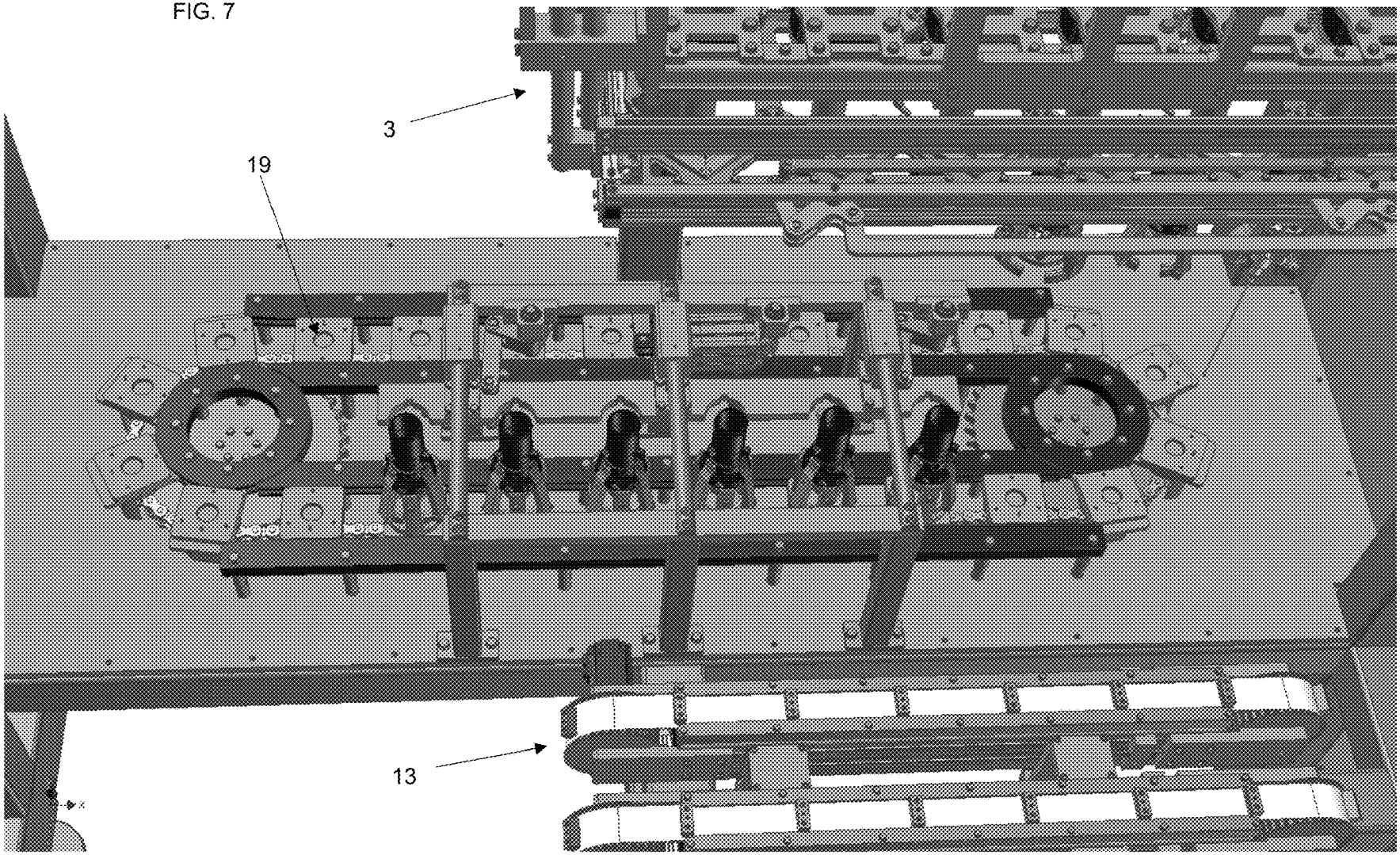
Figure 8:
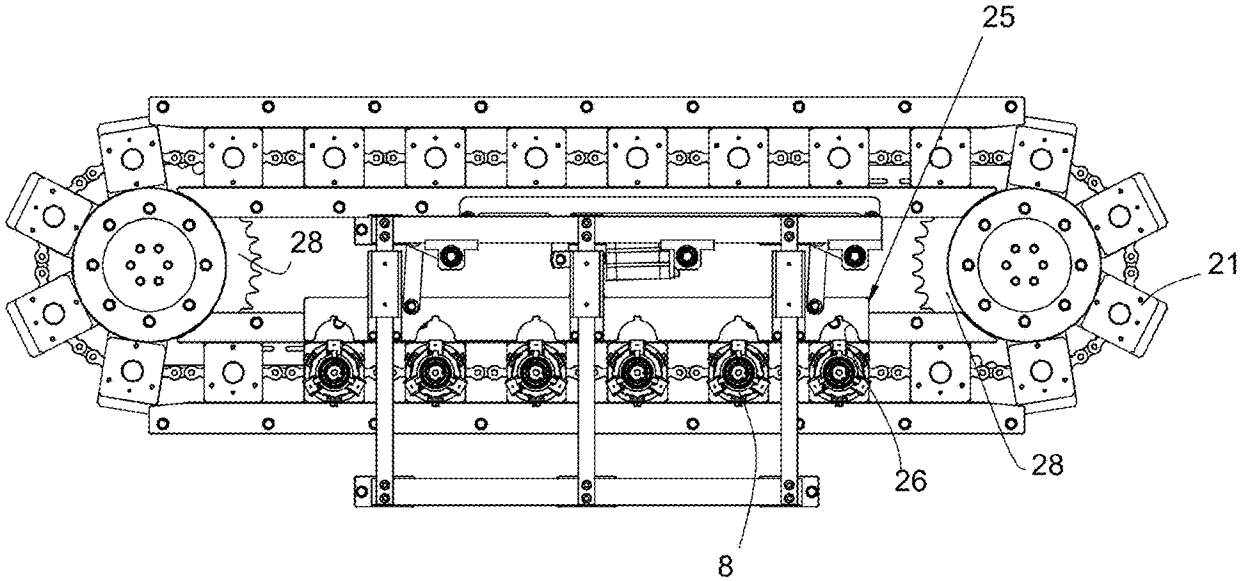
FIGS. 8 and 9 show only the capping heads group or store, in two top views and one perspective view; the store is constituted of an assembly of support bases for the capping heads, advanced along a ring path using a dedicated catenary and related gearbox; each support base can accommodate and sustain a corresponding capping head; the picking-up and releasing of said capping heads being completely automatically executed by the same capping group or at least an abutment, moving between two limit positions, adapted to control the separation of the capping heads, i.e. the capping group spindles.
Figure 8:
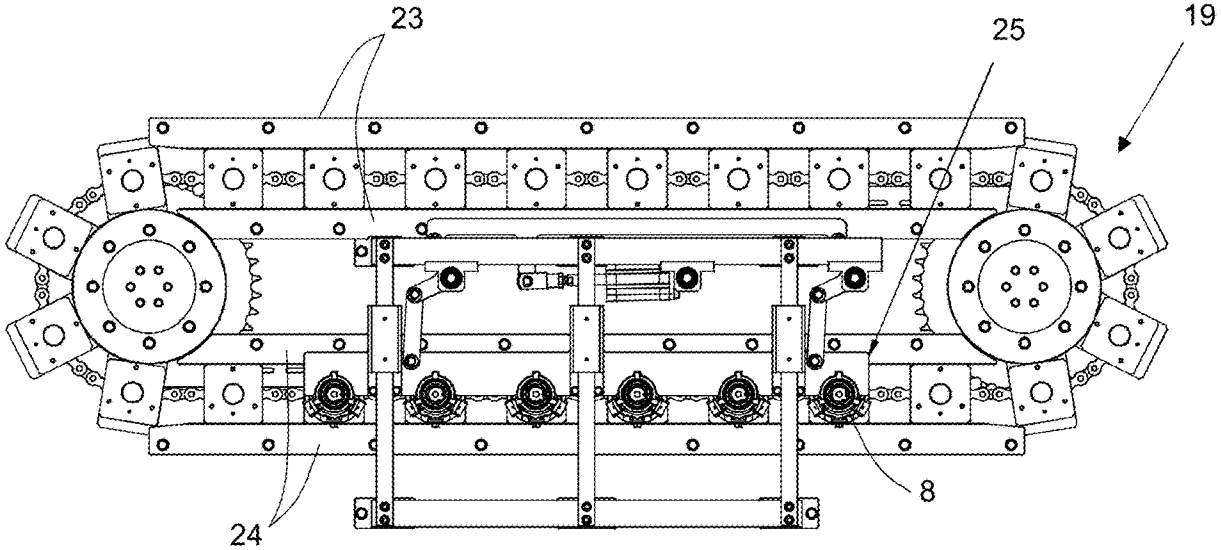
Figure 9:
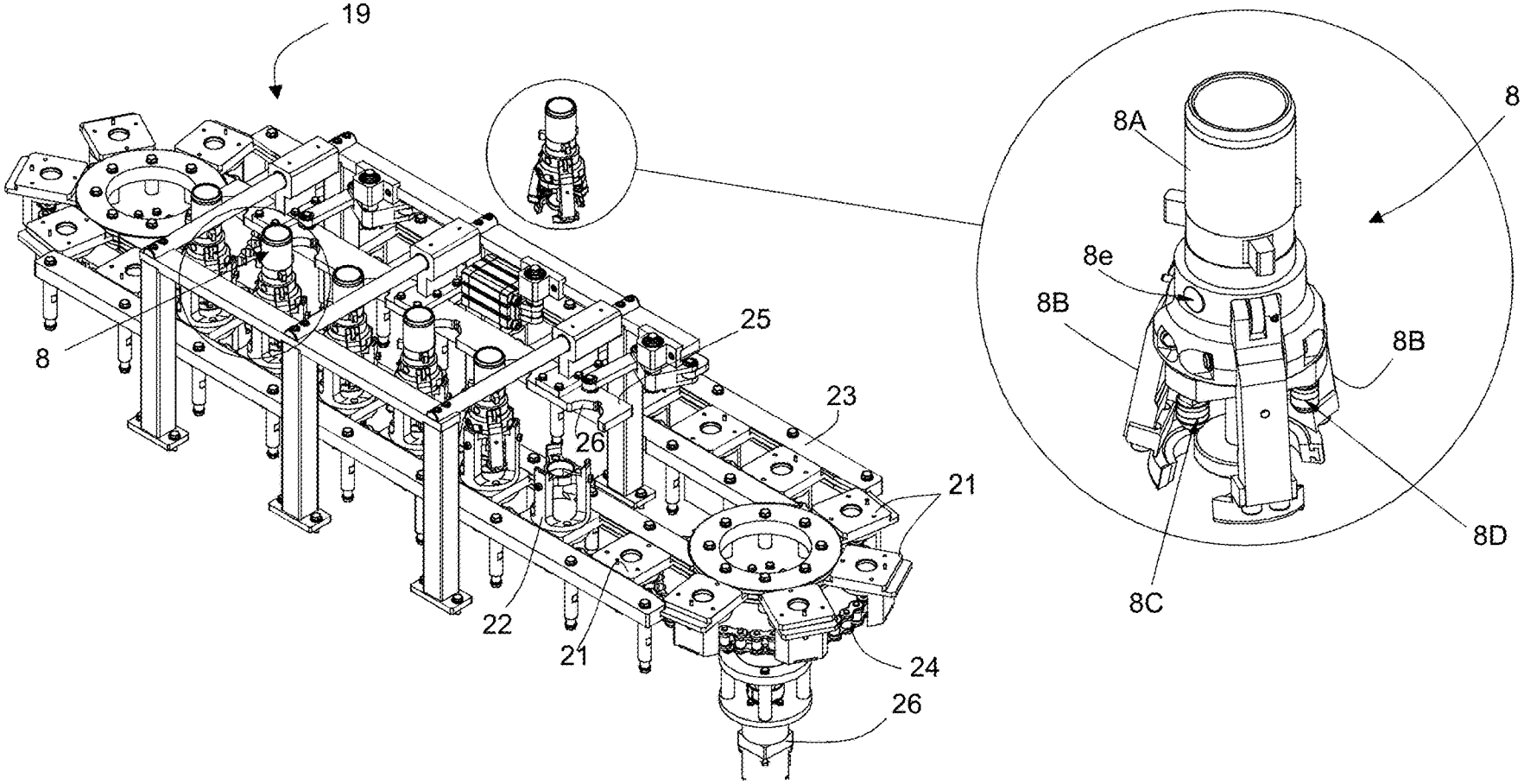

Particularly referring to FIGS. 7, 8 and 9, the aforesaid capping group or store 19 will be now described, together with its spindle—i.e. heads 8—coupling and uncoupling operating system, which is completely automatic, as explained below.

Precisely, the capping heads store group 19 is composed of a plurality of plates 21 integral to a catenary 24 wound on a closed ring path.

The catenary moves said plates 21 according to a horizontal sliding plane; for this purpose a couple of lateral runners 23 and 24 assist the plates guiding them along two linear paths linked together by catenary 24 revolving chainwheels 28, where at least one chainwheel is motorized, and referred as 26.

Support means 22 for the respective heads 8 are integral on top of plates 21; precisely, means 22 are positioned such that they can hold said heads 8 with holding means 8*b* pointing downwards, i.e. towards the plates 21, and pull studs 8*a* (which will be linked to the capping group 3) pointing upwards.

Furthermore, the store 19 comprises an abutment 25, i.e. a rod with a series of cavities 26 almost semicircular and shaped as the corresponding pull stud 8*a* of the respective head 8 to be uncoupled from group 3. Indeed, the pick-up and release of said capping heads 8 is executed in a completely automatic way, not only by the capping group 3 itself which provides to reach the support means 22, but also by said abutment 25, movable between two limit positions, i.e. one detached from (FIG. 8*a*) and the other one in contact with (FIG. 8B) the corresponding pull studs of the group to be uncoupled.

When group 3 requires to change format, therefore to change heads 8, it moves towards the store 19 by positioning the heads 8 in the related supports 22, then the abutment 25 is activated and brought into spindle decoupling position (FIG. 8B) and the rising of group 3 allows for the detachment from pull studs 8A.

Once group 3 is freed, and is now free of heads, the motorization 26 will select new heads for the next automatic coupling by the same group.

With 8*c* and 8*d* are identified two pins which extend downwards from each head 8; said pins being adapted to be housed in corresponding cavities of the means 22; having a different diameter, they provide for a unique positioning and direction in the center of the means 22 itself.

It is also present a piece coding sensor 8*e* which will be read by an analogous reading device on the working group 3.

Figure 4:
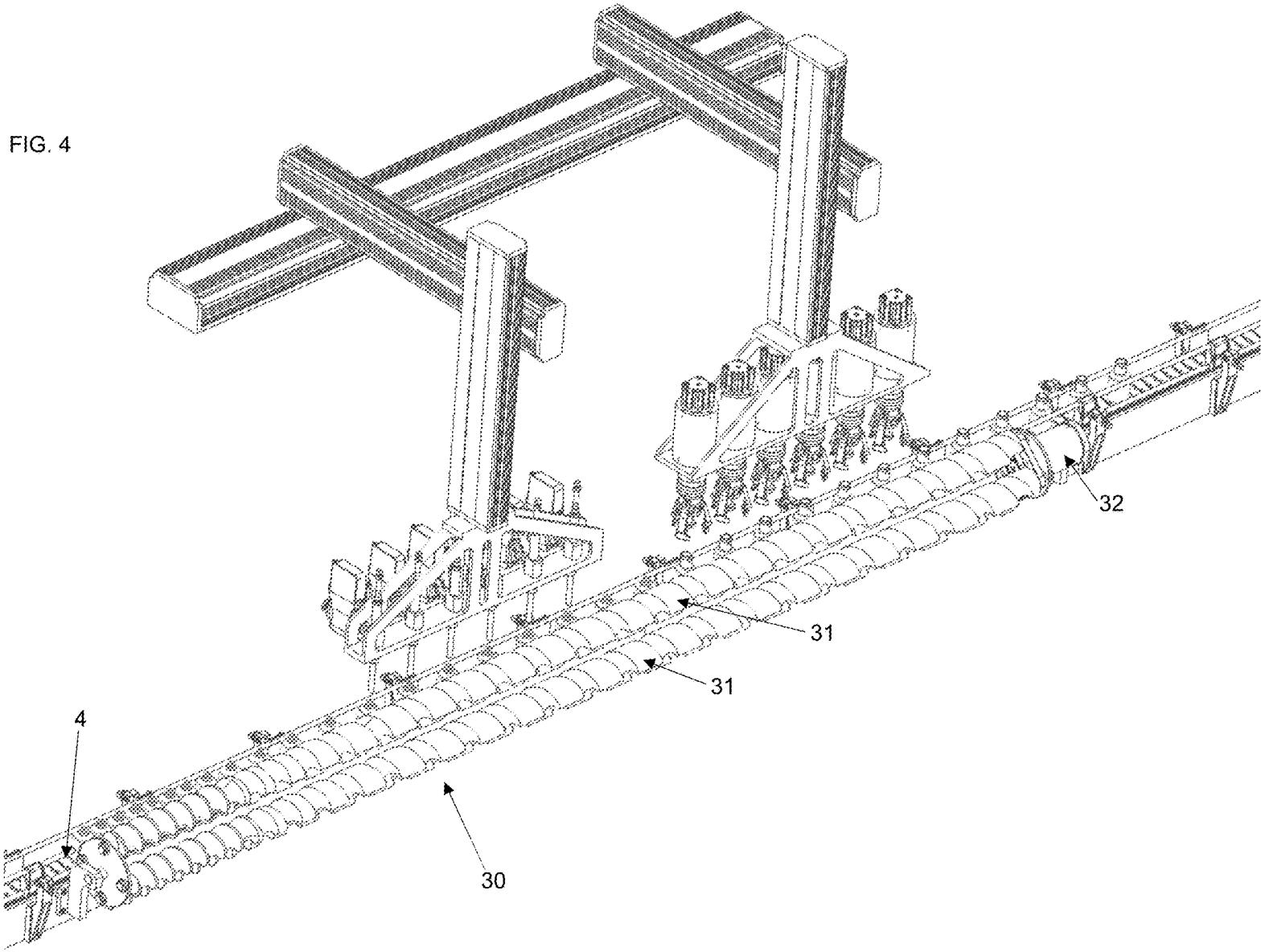
FIG. 4: Shows the capping unit, which bears a rotating device for advancing the articles, bearing in turn a plurality of pitch setting screw augers; the device for advancing the articles—by rotating on its axis—is adapted to select the adequate screw according to the format of the container or bottle to be filled and/or capped; said device for advancing the articles is associated, or i.e. adjacent, to the motorized transport line for advancing at least one row of objects to be capped and/or filled.

Referring to FIG. 4, it is shown at least one article advancing device 30 which is also part of the object of the finding.

Specifically, the device 30 is employed to keep the containers at the right pace such that they will be in place under the filling and capping heads. usually, according to the prior art, a screw auger is employed, which rotates with the rotation axis parallel to the advancing line such to pace the containers.

Figure 5:
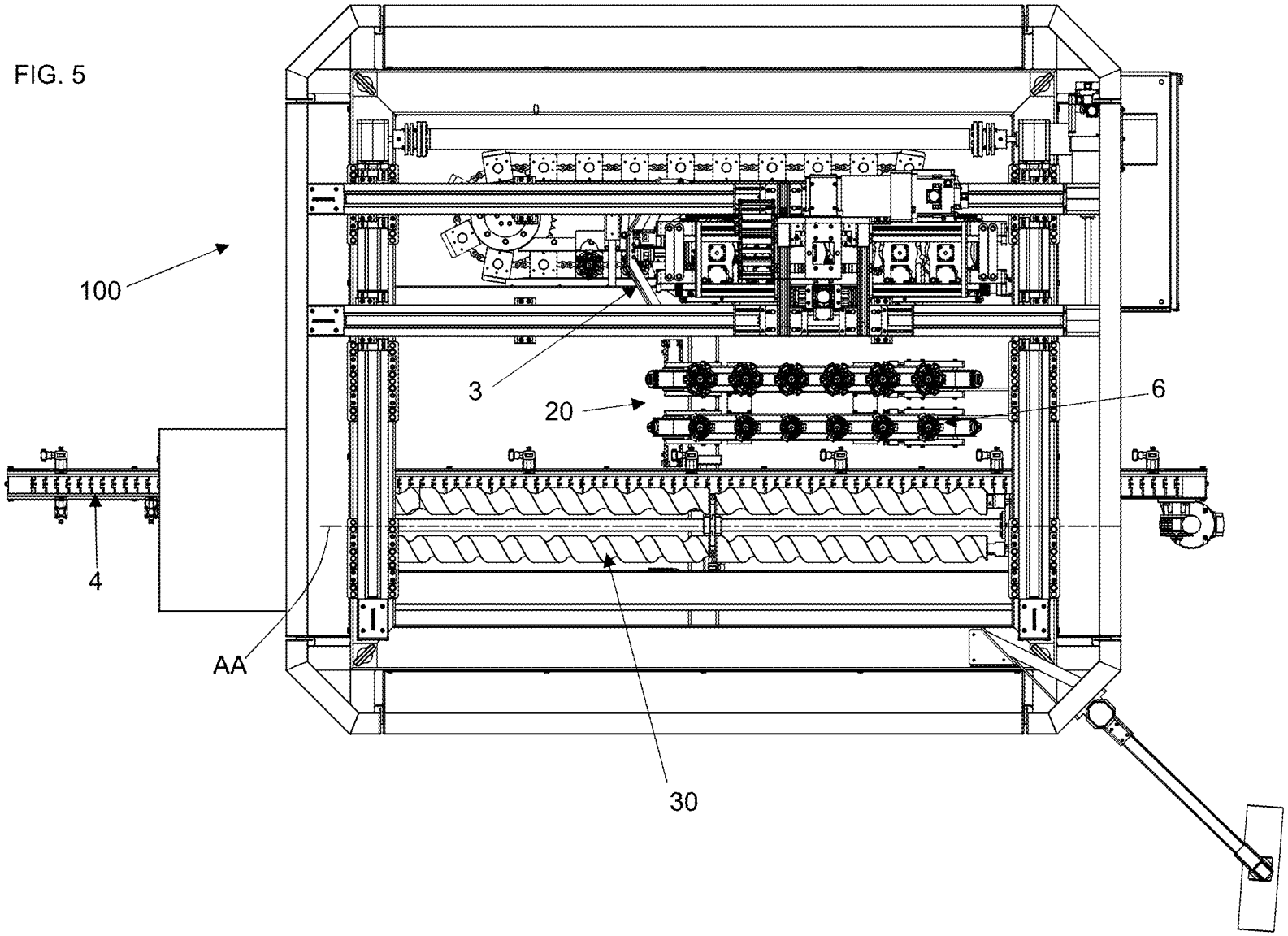
FIGS. 5, 6 and 7 show the part of the capping unit comprising the rotating device for advancing the articles, bearing a plurality of pitch setting screw augers which are selectable according to the format to be filled and capped; comprising at least one or more group for providing/supplying caps and/or capsules for the automatic pick up by means of said capping group; comprising the capping head store in which the capping heads can be automatically stored and/or picked up, as a function of the objects to be capped arriving on the moving line.

Overall, the apparatus 1 and the unit 100 claimed herein comprise also a device 30, rotatable on its own central rotation axis shown in FIG. 5 with reference AA; however in this case the device 30 comprises at least at the ends thereof a couple of rotating disks linked by a plurality of screw augers 31.

Precisely, the plurality of screw augers 31 is positioned at the periphery of the lateral disks as shown in FIGS. 4 and 5 and each of the screw augers has a different geometric conformation or different pitch.

Being able to rotate around axis AA, using motorization 32, the device 30 can position and select, adjacent to containers transport line 4, the suitable screw auger 31 as a function of the format to be filled and/or cap 6 to be screwed.

Each screw auger 31 is free to rotate around its longitudinal axis, parallel to the direction of line 4.

In the example shown in the figure, the device 30 is integral to the motorized transport line 4 for advancing a row of objects to be capped, nevertheless it can be also fixed to the base or the lower part of the capping unit.

In any case it should be noted that the article advancing device 30 is itself rotatable around its own axis AA and bears in turn a plurality of pitch setting screw augers 31 such that at least one screw auger can be positioned along the article advancing line 4 and such that said screw auger 31 drives and paces the corresponding containers advancing on said line.

Therefore device 30 is positioned with axis AA parallel to line 4 and by rotating on its own axis AA selects the adequate screw conveyor as a function of the format of the container or bottle to be filled and/or capped. said article advancing device is associated, or adjacent, to the motorized transport line for advancing at least one row of objects to be capped and/or filled.

Particularly referring to FIGS. 4, 5, 6, 7, 8, 9, the capping unit 100 is arranged with the possible filling unit associated, comprising in combination or separated:

At least a rotating device 30 for the advancement of articles, bearing a plurality of pitch setting screw augers, selectable according to the format to be filled and capped;

Caps 6 and/or capsules supply/feeding lines 13, 14, 15, 16, . . . 20 for automatic pick-up by means of said capping group; said group adjacent to the apparatus and/or transport line. The supply lines can vary according to the line demands;

A capping heads store 19, previously described, in which the appropriate capping heads 8 can be automatically stored and/or picked up by the apparatus itself, according to the object to be capped arriving on the movement line.

The system provides for executing the screwing during at least one containers linear movement, i.e. in pursuit, using caps or threaded capsules.

When the filling group is present, both groups, the filling and the capping ones, move synchronously: they are synchronized by a couple of robots or by a shared three-axis motor system with linear motors and/or brushless motors for the rotation of recirculating ball screws or toothed belts, in order to position said groups according to a parallel, vertical and approaching direction with respect to the line for transporting objects.

The invention claimed is:

1. A capping unit (100) for articles including containers and bottles, the capping comprising:

a capping group (3) bearing one or more capping heads (8) for screwing caps (6) or capsules on said articles moved by a transport line (4), a capping heads store (19) that retains a series of the capping heads (8), each of the capping heads (8) of the series being configured for screwing caps (6) of a different size, the series of capping heads (8) including first capping heads (8) that screw on first caps (6) of a first size and second capping heads (8) that screw on second caps (6) of a second size, the retaining of the series of the capping heads (8) by the capping heads store (19) allowing rapid and automatic exchange and substitution of the first capping heads (8) for the first size caps (6) with the second capping heads (8) for the second size caps (6) in the capping group (3), as well as automatic exchange and substitution of second capping heads (8) for the second size caps (6) with the first capping heads (8) for the first size caps (6), as a function of the size of the caps (6) or capsules to be screwed, and motorization that moves said capping group (3) from a first position to a second position reaching said store (19) such to allow said capping group (3) to pick up, for the automatic exchange and substitution of the capping heads (8) in the capping group (3), a suitable capping head (8) from said series as a function of the size of the caps (6) or capsules to be screwed, thereby providing for, in the capping group (3), automatic exchanging and substituting the first capping heads (8) with the second capping heads (8) as well as automatic exchanging and substituting the second capping heads (8) with the first capping heads (8) based on the size of the caps (6) or capsules to be screwed.

2. The capping unit (100) according to claim 1, wherein said capping heads store group (19) comprises:

a plurality of plates (21) integral to a catenary (24) wound on a closed ring path; the catenary moves said plates (21) according to a horizontal sliding plane;

a support (22) integral on top a respective one of each of the plates (21), each support (22) shaped for supporting one of the respective capping heads (8) on top of the respective one of the plates (21) with holding means (8*b*) of the capping head (8) pointing downwards towards the respective one of the plates (21), and pull studs (8*a*) of the capping head (8), which will be linked to the capping group (3), pointing upwards away from the respective one of the plates (21).

3. The capping unit (100) according to claim 2, wherein the store (19) comprises an abutment (25) shaped as the corresponding pull stud (8*a*) of the respective head (8) to be uncoupled from the capping group (3).

4. The capping unit (100) according to claim 3, wherein the pick-up and release of said capping heads (8) is executed in a completely automatic way, by the capping group (3) itself which provides to reach the support (22) and by said abutment (25), movable between two limit positions, i.e. one detached from and the other one in contact with the corresponding pull studs (8*a*) of the group to be uncoupled.

5. The capping unit (100) according to claim 3, wherein said abutment (25) is a rod with a series of cavities (26).

6. The capping unit (100) according to claim 2, wherein lateral runners (23) assist the plates (21) guiding the plates (21) along two linear paths linked together by the catenary (24) revolving chainwheels (28), where at least one of the chainwheels is motorized (26).

7. The capping unit (100) according to claim 2, wherein downwards from each capping head (8) are pins (8*c*) and (8*d*); said pins being adapted to be housed in corresponding cavities of the support (22) and having a different diameter, the pins providing for a unique positioning and direction in a center of the support (22) itself.

8. The capping unit (100) according to claim 2, wherein a reading device on the capping group (3) is provided and able to read an analogous piece coding sensor (8*e*).

9. The capping unit (100) according to claim 1, wherein the capping unit is a self sustaining modular unit, aside of the transport line (4).

10. The capping unit (100) according to claim 3, wherein the pick-up and release of said capping heads (8) is executed in a completely automatic way, by the capping group (3) itself which provides to reach the support (22) and by said abutment (25), movable between two limit positions, one detached from and the other one in contact with the corresponding pull studs (8*a*) of the group to be uncoupled.

* * * * *